United States Patent [19]

Conforti

[11] 4,258,261

[45] Mar. 24, 1981

[54] ELECTRODE ASSEMBLY FOR COMBUSTION PRODUCTS DETECTOR

[75] Inventor: Frederick J. Conforti, Aurora, Ill.

[73] Assignee: Pittway Corporation, Aurora, Ill.

[21] Appl. No.: 36,289

[22] Filed: May 7, 1979

[51] Int. Cl.[3] ..... H01J 39/28

[52] U.S. Cl. ..... 250/381

[58] Field of Search ..... 250/381, 384, 385, 382, 250/389; 313/54; 340/629

[56] References Cited

U.S. PATENT DOCUMENTS

| | | | |
|---|---|---|---|
| 3,767,917 | 10/1973 | Lampart et al. | 313/54 |
| 4,012,729 | 3/1977 | Weaver et al. | 250/381 |
| 4,044,263 | 8/1977 | Ried et al. | 250/381 |
| 4,081,684 | 3/1978 | Wieder | 250/381 |
| 4,150,373 | 4/1979 | Ried | 250/381 |

*Primary Examiner*—Alfred E. Smith
*Assistant Examiner*—Carolyn E. Fields
*Attorney, Agent, or Firm*—Vogel, Dithmar, Stotland, Stratman & Levy

[57] ABSTRACT

This electrode assembly includes two relatively large-diameter, parallel conductive discs spaced apart by an annular insulator which has peripheral flanges respectively encompassing the perimeters of the discs. The assembly is adapted to be disposed in an ionization chamber formed by a printed circuit board and a conductive cup mounted thereon. One of the discs has conductive mounting legs adapted to be snap-fitted into complementary openings in the circuit board for spacing the disc from the board a distance sufficient to permit the mounting of associated electronic components therebetween. Both discs have pronged attachment apertures adapted for one-way press-fitting engagement with corresponding attachment posts on the insulating body, one disc having a central aperture for mounting an associated radioactive source thereon. The other disc cooperates with the one disc to define a reference zone therebetween and cooperates with the metal cup to define a sampling zone of the ionization chamber.

20 Claims, 10 Drawing Figures

ELECTRODE ASSEMBLY FOR COMBUSTION PRODUCTS DETECTOR

BACKGROUND OF THE INVENTION AND PRIOR ART STATEMENT

This invention relates to combustion products detectors of the type having a single ionization chamber with reference and sampling zones therein and a single radioactive source. More particularly, the present invention relates to an electrode assembly for the ionization chamber.

This general type of single-source, single-ionization chamber combustion products detector is disclosed in U.S. Pat. No. 4,044,263, issued on Aug. 23, 1977. That detector includes a conductive housing which forms a first electrode of the system, and a small second electrode disposed within the housing and connected to a radioactive source. A voltage source is applied across these two electrodes, which are connected in series. Interposed between these two electrodes is a third long, thin electrode which is connected to detecting and alarm circuitry, which cooperates with the second electrode to define a reference zone therebetween, and which cooperates with the first electrode to define a sampling or signal zone therebetween.

This arrangement of U.S. Pat. No. 4,044,263 has the disadvantage that the two electrodes disposed within the ionization chamber formed by the conductive housing electrode are of very small area, thereby resulting in reduced sensitivity of the device. Furthermore, the geometry of these electrodes is such that there is negligible isolation of the reference zone from the sampling zone of the ionization chamber. Thereby further limiting the sensitivity and precision of the instrument. It is known to use instead of these two inner electrodes of U.S. Pat. No. 4,044,263, two small conductive rings separated by an insulator. But such rings also have a very small conductive area and remain relatively ineffective in providing isolation of the reference zone of the ionization chamber.

Furthermore, the prior art systems of the type disclosed in U.S. Pat. No. 4,044,263 have a relatively bulky ionization chamber which may be several inches in depth and in excess of six inches in width, and the other electronic circuit components are typically mounted outside the ionization chamber. When the other bulky components of the system such as audio signal generator, batteries and the like are added, there results a relatively large overall package.

A further disadvantage of these prior art systems is that assembly of the ionization chamber and the electrodes therein requires the use of a number of fasteners and associated tools, thereby adding to the overall cost of manufacturing the unit.

The aforementioned prior art is the most pertinent prior art known to the applicant, and U.S. Pat. No. 4,044,263, copy of which is filed herewith, is the most pertinent printed publication known to applicant which discloses such prior art.

SUMMARY OF THE INVENTION

The present invention relates to an improved combustion products detector of the type having a single source and a single ionization chamber with reference and sampling zones therein, and which avoids the disadvantages of prior art detectors while affording other important structural and operating advantages.

It is a general object of this invention to provide an electrode assembly for the ionization chamber of such a combustion product detector, which is adaptable for use in a very compact ionization chamber, and which is characterized by simplicity and ease of manufacture and assembly.

It is an important object of this invention to provide an electrode assembly of the type set forth which provides electrodes which are relatively large in comparison to the overall size of the ionization chamber and which, in particular, provide a relatively large surface area.

It is another object of this invention to provide an electrode assembly of the type set forth, which provides a clearly defined reference zone which is effectively separated and isolated from the remainder of the ionization chamber.

Still another object of this invention is the provision of an electrode assembly of the type set forth which provides for the mounting of associated electronic components within the ionization chamber.

Still another object of this invention is the provision of an electrode assembly of the type set forth, wherein the electrodes can be assembled together with their associated insulator and mounted within the ionization chamber without the use of any tools.

These and other objects of the invention are attained by providing an electrode assembly for a combustion products detector which includes means defining an ionization chamber and a first electrode therein and having openings allowing the introduction of ambient air and products of combustion thereinto and a source of radiation disposed within the ionization chamber, the assembly comprising a flat plate-like second electrode mounted in the ionization chamber and spaced from the first electrode, a flat platelike third electrode disposed in the ionization chamber, and insulating means maintaining the third electrode spaced from the first and second electrodes for cooperation respectively therewith to define a sampling zone and a reference zone within the ionization chamber, the third electrode having a small opening therein providing communication between the reference zone and the sampling zone.

Further features of the invention pertain to the particular arrangement of the parts of the electrode assembly whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
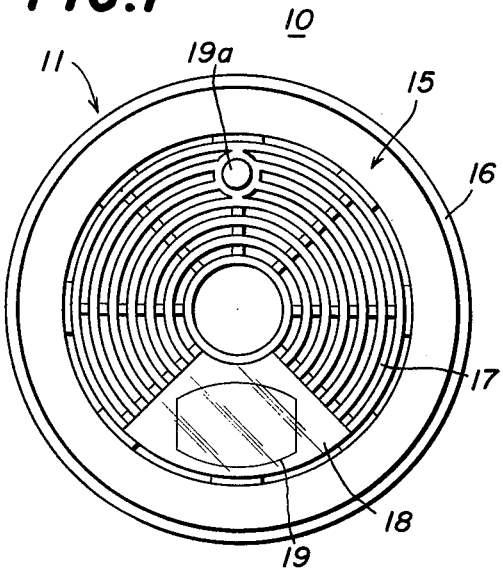
FIG. 1 is a top plan view of the combustion products detector of the present invention.
Figure 2:
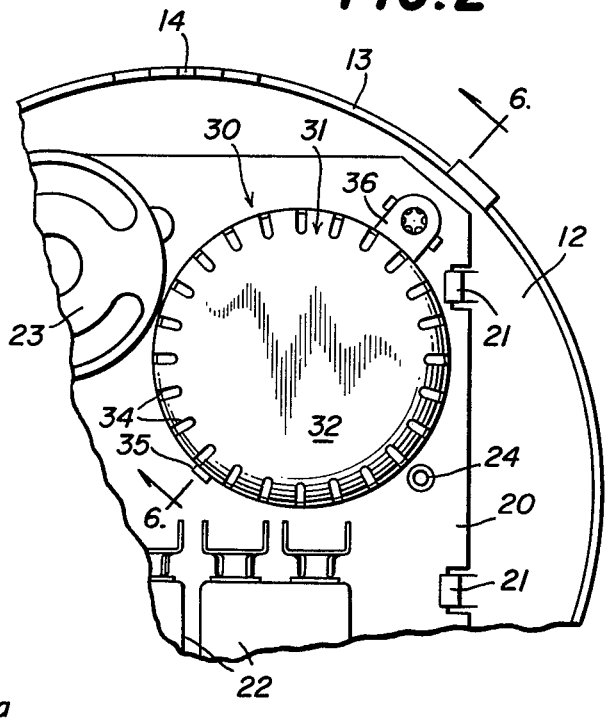
FIG. 2 is an enlarged, fragmentary top plan view of a portion of the combustion products detector of FIG. 1 with the cover removed, illustrating the ionization chamber assembly.

Referring now to FIGS. 1 and 2 of the drawings, there is illustrated a combustion products detector, generally designated by the numeral 10, which includes a case 11 having a circular base 12 provided with a peripheral upstanding flange 13 having attachment means 14 at spaced-apart points therealong, and a cover 15 which is generally cup-shaped and is provided with a peripheral flange 16 adapted to fit over the base flange 13 and is provided with attachment means (not shown) for mating with the attachment means 14 on a base 12. The cover 15 includes an end wall portion perforated with circular slots or grooves to form a grille 17 for permitting ambient air and combustion products to enter the case 11. A portion of the cover 15 is made up of a lens panel 18 formed of a translucent or transparent material to permit the emission of light rays from a test lamp 19 mounted on the base 12. The test lamp 19 may be actuated by depression of a test button 19a which projects upwardly through a complementary opening in the cover 15. Preferably, the case 11 is formed of plastic, and the attachment means therefor are adapted so that the cover 15 may be press or snap-fitted together with the base 12 for ease of mounting or removal without the use of tools. Suitable mounting means (not shown) are provided for mounting the combustion products detector 10 on a support surface such as a ceiling, wall or the like.

Figure 6:
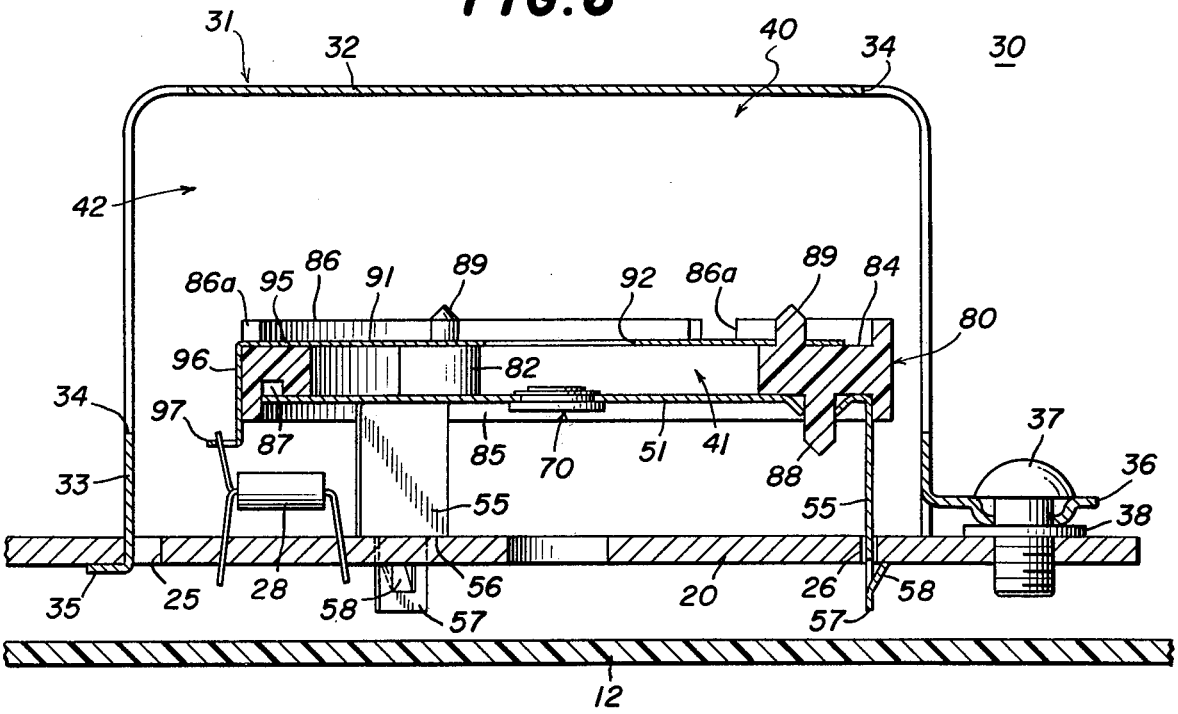
FIG. 6 is an enlarged view in vertical section taken along the line 6—6 in FIG. 2.

Mounted within the case 11 on the base 12 is a printed circuit board 20 which may be formed of plastic or other suitable electrically insulating material, and is held in place by a plurality of hold-down fingers 21 which are preferably integral with the base 12. Also mounted on the base 12 are suitable electric storage batteries 22 for powering the combustion products detector 10. Mounted on the circuit board 20 are all of the electronic components of the combustion products detector 10, including the test lamp 19, a buzzer or other sound generating device 23, a light emitting diode 24 which forms a part of the test apparatus, and monitoring circuitry including a number of electronic components, printed circuit connections (not shown) among which are formed on the underside of the printed circuit board 20, as viewed in FIG. 6. Formed through the circuit board 20 are a number of holes such as 25 and 26 (see FIG. 6) for a purpose to be described more fully below. While the specific components of the test and monitoring circuitry form no part of the present invention and are, therefore, not shown in the drawings, a representative component 28 is shown in FIG. 6 to illustrate a possible mounting location therefor.

Referring now also to FIGS. 3 through 6 of the drawings, there is mounted on the printed circuit board 20 an ionization chamber assembly, generally designated by the numeral 30, which includes a metal, generally cup-shaped housing 31 which is preferably of one-piece construction and includes a circular end wall 32 and a cylindrical side wall 33 provided with a plurality of equidistantly spaced-apart elongated slots 34 therein. Integral with the side wall 33 and extending downwardly and outwardly therefrom is a mounting finger 35 adapted to be received in the complementary opening 25 in the printed circuit board 20. Also integral with the side wall 33 and extending radially outwardly therefrom diametrically opposite the mounting finger 35 is an attachment tab 36 adapted to receive therethrough a threaded fastener, such as a tamper-resistant screw 37, for fixedly securing the housing 31 to the printed circuit board 20. For this purpose, there is preferably provided a nut 38 secured to the printed circuit board 20 by tabs 39 and threadedly engageable with the screw 37.

The housing 31 cooperates with the printed circuit board 20 to define therebetween an ionization chamber, generally designated by the numeral 40. Preferably, the housing 31 is only about one inch in height and about two inches in diameter and occupies only a small portion of the volume within the case 11, as can be best seen in FIG. 2. It will be appreciated that the slots 34 permit the entry of ambient air and combustion products into the ionization chamber 40.

The ionization chamber assembly 30 also includes a radiation source holder plate, generally designated by the numeral 50, which is in the form of a thin, flat conductive disc 51 which has a small circular aperture 52 therethrough centrally thereof and three irregular attachment apertures 53 equiangularly spaced apart adjacent to the outer edge thereof. Each of the attachment apertures 53 is generally circular in overall outline, but includes three prongs 54 extending radially thereinto for a purpose to be explained below. Integral with the disc 51 at the outer edge thereof and extending therefrom substantially normal thereto at equiangularly spaced-apart locations therealong are three conductive mounting legs 55, each generally flat and rectangular in shape and being provided at the lower end thereof with a narrow mounting foot 57. The lateral edges of each foot 57 are respectively offset from the lateral edges of the leg 55 by shoulders 56, each narrow foot 57 being provided with a cut-out prong 58 extending therefrom at an angle thereto.

Figure 3:
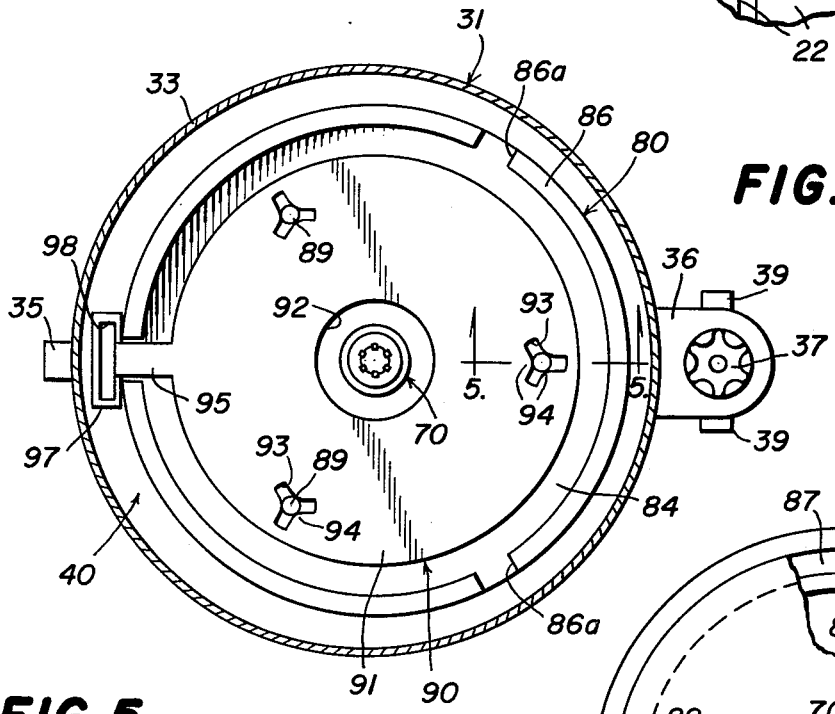
FIG. 3 is a further enlarged top plan view of the ionization chamber assembly of FIG. 2, rotated 45 degrees, and with the top of the housing thereof broken away to illustrate the electrode assembly therein.
Figure 4:
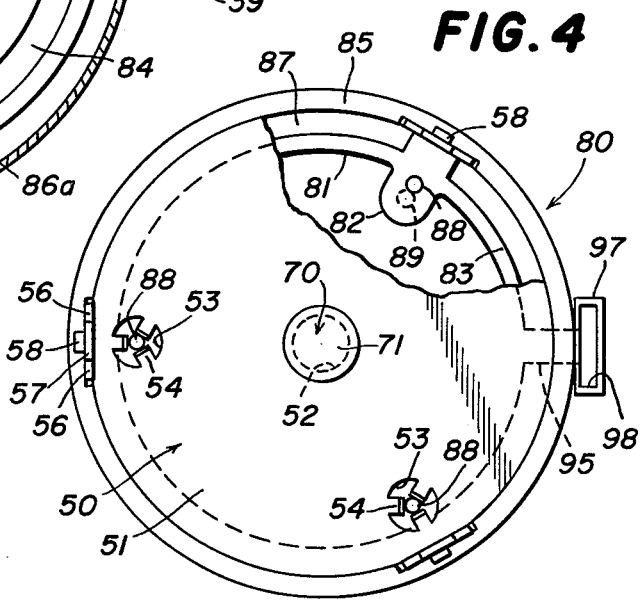
FIG. 4 is a bottom plan view of the reverse side of the electrode assembly illustrated in FIG. 3, rotated 180 degrees.
Figure 5:
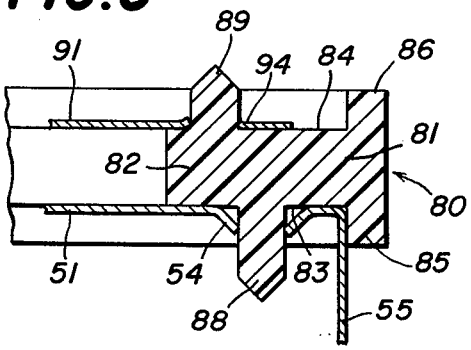
FIG. 5 is a still further enlarged fragmentary view in vertical section taken along the line 5—5 in FIG. 3.

In use, the mounting feet 57 are respectively inserted into the complementary holes 26 in the printed circuit board 20, the prongs 58 being deflectable to permit this insertion. The feet 57 are inserted until the shoulders 56 engage the upper surface of the printed circuit board 20, as viewed in FIG. 6, at which point the prongs 58 clear the lower ends of the holes 26 and spring out to their normal positions for engagement with the underside of the printed circuit board 20, thereby securely to mount the disc 51 on the circuit board 20. It will be noted that the disc 51 is positioned so that it will be within the ionization chamber 40 after the housing 31 is mounted in place, the length of the legs 55 being such that the disc 51 is spaced a predetermined distance from the printed circuit board 20 and substantially parallel thereto so as to permit the mounting therebetween of electronic circuit components such as the component 28. In actual assembly, the source holder plate 50 would be mounted in place after the circuit components have been wired to the printed circuit board 20. Preferably, the source holder plate 50 is arranged non-coaxially in the ionization chamber 40, as best illustrated in FIGS. 3 and 6.

The conductive housing 31 forms a first electrode of the ionization chamber assembly 30, a second electrode thereof being formed by the source holder plate 50. In use, a voltage source, provided by the batteries 22, is connected across these electrodes through a resistor, connection thereto being made as at the feet 57 and the screw 37.

Figure 7:
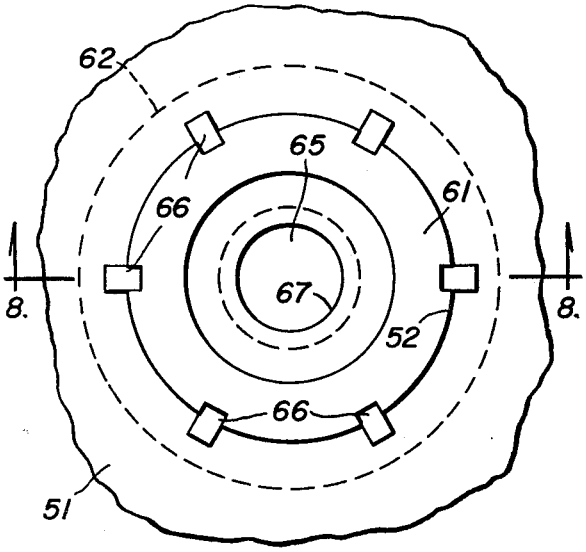
FIG. 7 is a still further enlarged fragmentary top plan view of one embodiment of a radioactive source module for the present invention.
Figure 9:
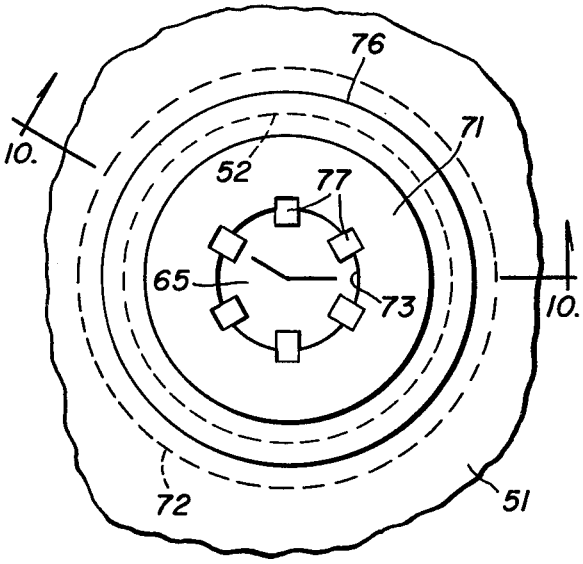
FIG. 9 is a view similar to FIG. 7, showing another embodiment of a radioactive source module for the present invention.
Figure 8:
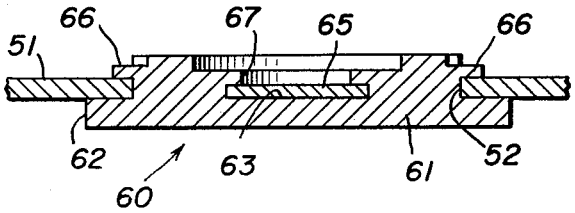
FIG. 8 is a view in vertical section taken along the line 8—8 in FIG. 7.
Figure 10:
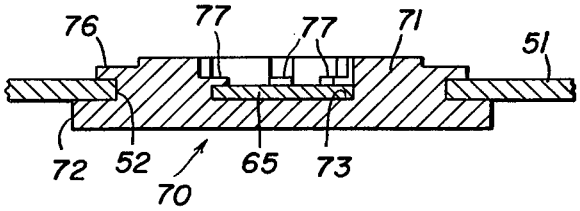
FIG. 10 is a view in vertical section taken along the line 10—10 in FIG. 9.

Referring now also to FIGS. 7 through 10 of the drawings, there is mounted on the source holder plate 50 a source module, generally designated by either the numeral 60 or the numeral 70, the former being illustrated in detail in FIGS. 7 and 8 and the latter being illustrated in detail in FIGS. 9 and 10. At present, the preferred embodiment of source module is the module 70, but the modules 60 and 70 will be described in numerical order. The source module 60 includes a carrier body 61 which is generally circular in shape and is provided at one end thereof with a radially outwardly extending peripheral flange 62. Formed in the opposite end of the carrier body 61 centrally thereof is a circular recess 63 in which is disposed a body 65 of radioactive material, typically an alpha particle emitter of a type well known in the art.

In assembly, the carrier body 61 is inserted upwardly through the aperture 52 in the disc 51, until the peripheral flange 62 engages the underside of the disc 51, as viewed in FIGS. 6 and 8. The upper end of the carrier body 61 is then deformed by a suitable die to form a plurarity of radially outwardly extending retaining fingers 66 which overlap the upper surface of the disc 51, and a radially inwardly extending annular retaining flange 67 which overlaps the outer edge of the body 65 of radioactive material. Thus, the body 65 of radioactive material is held firmly in place in the carrier body 61 by the retaining flange 67, and the carrier body 61 is securely attached to the disc 51 by the retaining fingers 66.

Similarly, the source module 70 includes a carrier body 71 having a peripheral flange 72 at one end thereof and having a central recess 73 formed in the other end thereof. In assembly, the carrier body 71 is inserted upwardly through the aperture 52 in the disc 51 with the peripheral flange 72 engaging the underside thereof. Then, a suitable die deforms the upper end of the carrier body 71 to form a radially outwardly extending annular retaining flange 76 which overlaps the upper surface of the disc 51 securely to mount the carrier body 71 thereon, and a plurality of radially inwardly extending retaining fingers 77 which overlap the outer edge of the body 65 of radioactive material, securely to retain it in the carrier body 71. It will be appreciated that other variants of the source module 70 could also be utilized, such as die-formed retaining fingers for both mounting of the carrier body on the disc 51 and for retention of the body 65 of radioactive material. Similarly, annular flanges could be used for both purposes.

Preferably, before it is mounted on the printed circuit board 20, the source holder plate 50 is assembled with an insulating spacer, generally designated by the numeral 80. The insulating spacer 80 is of unitary one-piece construction and includes an annular body 81 provided with three radially inwardly extending projections 82 spaced equiangularly therearound and having flat planar lower and upper surfaces 83 and 84 substantially parallel to each other. Integral with the lower surface 83 at the outer edge thereof and extending outwardly therefrom substantially normal thereto around the entire perimeter thereof is a lower flange 85. Integral with the upper surface 84 at the outer edge thereof and extending outwardly therefrom substantially normal thereto around the entire perimeter thereof is an upper flange 86, having three notches 86a formed therein at equiangularly spaced-apart points therealong. Formed in the lower surface 83 is an annular groove or recess 87. Integral with the lower surface 83 and extending therefrom substantially normal thereto, respectively at the three projections 82, are three lower posts 88, each of which extends a predetermined distance beyond the outer edge of the flange 85. Similarly, three upper posts 89 are respectively integral with the upper surface 84 at the projections 82 and extend upwardly therefrom substantially normal thereto, slightly beyond the outer edge of the upper flange 86.

The lower posts 88 have pointed ends and are dimensioned and arranged respectively to be received through the attachment apertures 54 of the disc 51, the diameter of each post 88 being slightly greater than the inner diameter of the apertures 53 as measured between the inner ends of the prongs 54. Thus, the prongs 54 are deflected opposite to the direction of insertion by the posts 88 and resiliently engage the outer surfaces of the posts 88 effectively to prevent retrograde movement of the posts 88 which might tend to disengage them from the disc 51. Preferably, the insulating spacer 80 is dimensioned so that when the posts 88 thereof are engaged with the disc 51 in the manner described above, the upper surface of the disc 51 will lie against the lower surface 83 of the insulating spacer 80 and within the confines of the lower flange 85, the thickness of the disc 51 preferably being substantially less than the axial height of the flange 85. Thus, it will be appreciated that the source holder plate 50 and the insulating spacer 80 can be pressfitted together without the use of any tools.

The ionization chamber assembly 30 also includes a reference target plate, generally designated by the numeral 90, which includes a conductive disc 91 having an outer diameter slightly less than that of the source holder plate 50, and having a central circular aperture 92 formed therethough, the aperture 92 being slightly larger than the central aperture 52 formed through the source holder plate 50. Also formed through the disc 91 adjacent to the outer edge thereof at equiangularly spaced-apart locations therearound are three irregular attachment apertures 93, each having three short prongs 94 projecting radially thereinto. Integral with the disc 91 and extending radially outwardly therefrom is a thin, flat, conductive projection 95 provided at the distal end thereof with a depending leg 96 which extends therefrom substantially normal thereof. The depending leg 96 has at its distal end an outturned contact foot 97 provided with a rectangular aperture 98 therethrough.

In use, the reference target plate 90 forms a third electrode of the ionization chamber assembly 30, and is assembled to the insulating spacer 80 by press-fitting the mounting apertures 93 respectively over the pointed upper posts 89 in essentially the same manner as was described below with respect to the assembly of the source holder plate 50 to the insulating spacer 80. More particularly, the diameter of the posts 89 is slightly greater than the inner diameter of the attachment apertures 93, as measured between the ends of the prongs 94, whereby the posts 89 will slightly deflect the prongs 94 in the direction of insertion, so that the engagement of the prongs 94 with the posts 89 will inhibit accidental disassembly of the parts. When thus assembled, the disc 91 will lie flat against the upper surface 84 of the insulating spacer body 81 and will be entirely within the confines of the upper flange 86, and spaced radially inwardly a predetermined distance therefrom. The projection 95 extends outwardly through one of the notches 86*a* in the upper flange 86, the depending leg 96 being dimensioned to extend downwardly along the outer surface of the insulating body 80 a predetermined slight distance below the outer edge of the lower flange 85, as best seen in FIG. 6. The contact foot 97 is then available for providing electrical contact, as by a solder connecting or the like, with an associated electronic circuit component, such as the component 28, disposed on the printed circuit board 20 beneath the source holder 50.

It will be appreciated that the parts are so arranged and spaced that the projection 95 of the disc 91 can selectively be positioned in any one of the notches 86a, and the attachment apertures 93 will still be in registry with the upper posts 89. Also, the prongs 94 of the attachment apertures 93 are preferably shorter and less sharp than are the prongs 54 in the source holder plate 50, whereby the prongs 94 engage the upper posts 89 relatively less firmly and are only slightly deflected thereby (see FIG. 5). Thus, while accidental dislodgement of the reference target plate 90 is inhibited, it is still possible, if necessary, to remove the reference target plate 90 from the insulating spacer 80 for repositioning of the projection 95. This removal of the reference target plate 90 is also facilitated by the fact that the upper posts 89 are slightly shorter than the lower posts 88.

In assembling the ionization chamber assembly 30, the electronic circuit components are preferably first wired to the printed circuit board 20. Then the insulating spacer 80 is assembled with the source holder plate 50 and the reference target plate 90 to form an electrode assembly, after which this assembly is mounted on the printed circuit board 20 by insertion of the feet 57 in the complementary openings 26. Finally, the housing 31 is mounted on the printed circuit board 20 to complete the ionization chamber assembly 30. It can be seen that, when thus assembled, the source holder plate 50 and the reference target plate 90 are arranged substantially parallel to each other and are spaced apart a predetermined distance for cooperation with the insulating spacer 80 to define a reference zone 41 therebetween (see FIG. 6), the reference target plate 90 also cooperating with the end wall 32 of the housing 31 for defining therebetween a signal or sampling zone 42 of the ionization chamber 40.

Preferably, the reference target plate 90 is connected via the contact foot 97 to detector and alarm circuitry for monitoring the voltage across the sampling zone 42 between the electrode formed by the reference target plate 90 and the electrode formed by the housing 31 as the ion flow therebetween is altered by combustion products entering the ionization chamber 40, all in a well-known manner. The reference current through the ionization chamber 40, which is established by the degree of source radioactivity creating the ionized environment in the reference zone 41, is substantially constant. This constant current condition is facilitated by the fact that the reference zone 41 is substantially completely enclosed except for the access opening 92 in the reference target plate 90 which permits alpha particles from the source body 65 to enter the sampling zone 42.

It will be appreciated that the large contact surface area of the electrodes formed by the plates 50 and 32 serve to maximize the collection of ions thereon, thereby greatly to enhance the sensitivity of the system, as well as protecting the components from static discharge. Furthermore, it will be noted that the flanges 85 and 86 of the insulating spacer 80 serve as continuations of the lower and upper surfaces 83 and 84 thereof, lengthening the insulating surfaces and thereby improving the insulation against surface flow of current.

It has been observed that if the combustion products detector 10 is exposed to the wind or otherwise experiences relatively high velocity air currents flowing therethrough, the laminar flow of these air currents through the ionization chamber 40 can have the effect of sweeping particles from the radiation source out of the ionization chamber and preventing them from properly being collected at the electrodes formed by the housing 31 and the reference target plate 90. In order to prevent this phenomenon, there may be provided an annular deflecting member on the end wall 32 of the housing 31 which projects downwardly into the ionization chamber 40. Also, the upper flange 86 of the insulating body 80 may be extended upwardly into the sampling region 42 of the ionization chamber for cooperation with the deflector on the housing to deflect the airflow through the ionization chamber 40 and impede the progress thereof. This will tend to create turbulence in the air within the ionization chamber 40, but this turbulence is not as detrimental to particle collection on the electrodes as is relatively high velocity airflow through the ionization chamber 40.

In a constructional model of the ionization chamber assembly 30, the source holder plate 50, the source module carrier bodies 61 and 71 and the reference target plate 90 are all formed of stainless steel, the housing 31 is formed of stainless steel, and the insulating spacer is formed of a polyester material. However, it will be appreciated that the electrodes could be formed of other suitable conductive materials, and the insulating spacer 80 could be formed of other suitable insulating material.

From the foregoing, it can be seen that there has been provided an improved electrode assembly for the ionization chamber of a combustion products detector which is of simple and economical construction, is capable of assembly without tools into a compact, space-saving package, and provides an extremely large contact area optimizing the sensitivity and precision of the system.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. An electrode assembly for a combustion product detector which includes means defining a cylindrical ionization chamber having an axis and a first electrode therein and having openings allowing the introduction of ambient air and products of combustion thereinto and a source of radiation disposed within the ionization chamber, said assembly comprising a flat plate-like second electrode mounted in the ionization chamber non-coaxially therewith and spaced from the first electrode, a flat plate-like third electrode disposed in the ionization chamber, and insulating means closing the space between said second and third electrodes around the entire perimeter thereof and maintaining said third electrode spaced from said first and second electrodes for cooperation respectively therewith to define a sampling zone and a reference zone within the ionization chamber, said third electrode having a small opening therein providing the sole communication between said reference zone and said sampling zone.

2. The electrode assembly of claim 1, wherein said insulating means is fastened to each of said second and third electrodes.

3. An electrode assembly for a combustion product detector which includes means defining a cylindrical ionization chamber having an axis and a first electrode therein and having openings allowing the introduction of ambient air and products of combustion thereinto and a source of radiation disposed within the ionization chamber, said assembly comprising a second electrode mounted in the ionization chamber non-coaxially therewith and spaced from the first electrode and having attachment means, a third electrode disposed in the ionization chamber and having attachment means, and an insulating body having first and second attachment structure respectively disposed on opposite sides thereof, said first and second attachment structure being respectively adapted for press-fitting engagement with the attachment means of said second and third electrodes for secure attachment thereof to said insulating body in an assembled condition wherein said insulating body closes the space between said second and third electrodes around the entire perimeter thereof and maintains said third electrode spaced from said first and second electrodes for cooperation respectively therewith to define a sampling zone and a reference zone within the ionization chamber, said third electrode having a small opening therein providing the sole communication between said reference zone and said sampling zone.

4. The electrode assembly of claim 3, wherein said attachment means on said second and third electrodes comprises female attachment means and said attachment structure on said insulating body comprises male attachment structure.

5. The electrode assembly of claim 3, wherein at least one of said second and third electrodes is adapted for one-way press-fitting engagement with the corresponding attachment structure on said insulating body so as effectively to prevent subsequent disengagement thereof.

6. The electrode assembly of claim 3, wherein each of said second and third electrodes includes plural attachment means and each of said first and second attachment structure comprises plural attachment members respectively arranged for engagement with the attachment means of the corresponding electrode.

7. An electrode assembly for a combustion product detector which includes a printed circuit board and a conductive housing forming a first electrode and mounted on the circuit board for cooperation therewith to define a cylindrical ionization chamber having an axis and having openings allowing the introduction of ambient air and products of combustion thereinto and a source of radiation disposed within the ionization chamber, said assembly comprising a flat plate-like second electrode having an attachment aperture therein, means mounting said second electrode in the ionization chamber non-coaxially therewith substantially parallel to the circuit board and spaced therefrom and from the first electrode, a flat plate-like third electrode disposed in the ionization chamber and having an attachment aperture therein, and an insulating body having an opening therethrough and including first and second attachment posts respectively extending from opposite sides thereof, said first attachment post being adapted for press-fitted engagement in said attachment aperture of said second electrode securely to attach said insulating body thereto, said second attachment post of said insulating body being adapted for press-fitting engagement in said attachment aperture of said third electrode securely to fasten said insulating body thereto, whereby said insulating body closes the space between said second and third electrodes around the entire perimeter thereof and maintains said third electrode spaced from said first and second electrodes for cooperation respectively therewith to define a sampling zone and a reference zone within the ionization chamber, said third electrode having a small access opening therein cooperating with said opening in said insulating body for providing the sole communication between said reference zone and said sampling zone.

8. The electrode assembly of claim 7, wherein each of said first and second electrodes includes a plurality of spaced-apart attachment prongs extending into the attachment aperture thereof, said attachment prongs being adapted for deflection by the associated attachment post when it is inserted into the corresponding attachment aperture for engagement therewith effectively to inhibit disengagement of said post from said aperture.

9. The electrode assembly of claim 8, wherein said attachment prongs of said second electrode are longer than those of said third electrode for greater engagement by the corresponding post and firmer engagement therewith.

10. The electrode assembly of claim 7, wherein said second electrode has a central opening therethrough, and further including means receivable in said central opening for mounting the source of radiation on said second electrode.

11. The electrode assembly of claim 10, wherein said source mounting means includes a source carrier receivable through said central opening and deformable to form fastening members engageable with said second electrode about said central opening.

12. The electrode assembly of claim 7, wherein said second and third electrodes are circular in shape with said second electrode having a greater area than said third electrode, said insulating body being circular with said second attachment posts disposed radially inwardly of said first attachment posts.

13. The electrode assembly of claim 7, wherein said second electrode is spaced from said circuit board a distance sufficient to accommodate the placement of associated electronic circuit components therebetween.

14. The electrode assembly of claim 7, wherein each of said second and third electrodes includes a plurality of attachment apertures therein, said insulating body including a plurality of first and second attachment posts respectively equal in number to the attachment apertures of said second and third electrodes.

15. The electrode assembly of claim 7, wherein said means mounting said second electrode is adapted for snap-fitted engagement with the associated circuit board.

16. The electrode assembly of claim 7, wherein said means mounting said second electrode is conductive and forms a contact for connecting said second electrode to associated electronic circuitry.

17. An electrode assembly for a combustion product detector which includes a printed circuit board and a conductive housing forming a first electrode and mounted on the circuit board for cooperation therewith to define an ionization chamber and having openings allowing the introduction of ambient air and products of combustion thereinto and a source of radiation disposed within the ionization chamber, said assembly comprising a flat plate-like second electrode having an attachment aperture therein, means mounting said second electrode in the ionization chamber substantially parallel to the circuit board and spaced therefrom and from the first electrode, a flat plate-like third electrode disposed in the ionization chamber and having an attachment aperture therein, and an insulating body having an opening therethrough and including first and second spaced-apart flat mounting surfaces on opposite sides thereof and first and second attachment posts respectively extending from said mounting surfaces, first and second retaining flanges respectively integral with said first and second mounting surfaces and extending therefrom substantially normal thereto around the entire perimeter thereof, said second electrode being disposed against said first mounting surface within said first peripheral flange with said first attachment post being disposed in press-fitted engagement in said attachment aperture of said second electrode securely to attach said insulating body thereto, said third electrode being disposed against said second mounting surface within said second peripheral flange with said second attachment post being disposed in press-fitted engagement in said attachment aperture of said third electrode securely to fasten said insulating body thereto, whereby said insulating body maintains said third electrode spaced from said first and second electrodes for cooperation respectively therewith to define a sampling zone and a reference zone within the ionization chamber, said third electrode having a small access opening therein cooperating with said opening in said insulating body for providing communication between said reference zone and said sampling zone.

18. The electrode assembly of claim 17, wherein said second retaining flange has an opening therein, said third electrode including a contact member extending therefrom through said opening in said first retaining flange for connecting said third electrode to associated electronic circuitry.

19. The electrode assembly of claim 18, wherein said second retaining flange includes a plurality of openings therein spaced apart around the perimeter thereof, said contact member being selectively disposable in any one of said flange openings.

20. The electrode assembly of claim 17, and further including an annular deflector on the conductive housing and projecting into said sampling zone of the ionization chamber, said second retaining flange extending beyond said second posts into said sampling zone for cooperation with said deflector to deflect and impede the progress of laminar air currents passing through said sampling zone.

* * * * *